US006204724B1

(12) United States Patent
Kobatake

(10) Patent No.: US 6,204,724 B1
(45) Date of Patent: Mar. 20, 2001

(54) REFERENCE VOLTAGE GENERATION CIRCUIT PROVIDING A STABLE OUTPUT VOLTAGE

(75) Inventor: Hiroyuki Kobatake, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/276,151

(22) Filed: Mar. 25, 1999

(30) Foreign Application Priority Data

Mar. 25, 1998 (JP) ..... 10-077898

(51) Int. Cl.[7] ..... G05F 3/02
(52) U.S. Cl. ..... 327/541; 327/543
(58) Field of Search ..... 323/312, 313, 323/314, 315; 327/530, 534, 535, 537, 538, 539, 540, 541, 543, 545, 546

(56) References Cited

U.S. PATENT DOCUMENTS

| | | | | |
|---|---|---|---|---|
| 5,481,179 | * | 1/1996 | Keeth | 323/315 |
| 5,483,196 | | 1/1996 | Ramet | 330/257 |
| 5,880,625 | * | 3/1999 | Park et al. | 327/543 |
| 5,900,773 | * | 5/1999 | Susak | 327/539 |
| 5,955,874 | * | 9/1999 | Zhou et al. | 323/315 |
| 6,031,365 | * | 2/2000 | Sharp-Geisler | 323/313 |
| 6,037,762 | * | 3/2000 | Koelling et al. | 323/313 |

FOREIGN PATENT DOCUMENTS

| | | |
|---|---|---|
| 0 350 857 | 1/1990 | (EP) . |
| 55-116114 | 9/1980 | (JP) . |
| 61-53804 | 3/1986 | (JP) . |
| 61-204216 | 12/1986 | (JP) . |
| 2-12509 | 1/1990 | (JP) . |

OTHER PUBLICATIONS

Koichi; "Circuit For Generating Reference Voltage"; Patent Abstracts of Japan; vol. 097, No. 012; Dec. 25, 1997; Publication No. 09 204233; Publication Date: Aug. 8, 1997.

* cited by examiner

*Primary Examiner*—Jeffrey Zweizig
(74) *Attorney, Agent, or Firm*—Foley & Lardner

(57) ABSTRACT

A reference voltage generation circuit includes a first current mirror including first through third transistors with the second transistor on a reference side thereof, a second current mirror including fourth and fifth transistors connected in series with the first and the second transistors, respectively, and a voltage control block for controlling the source-drain voltages the transistors on the output side of the first current mirror. The voltage control block includes a first control block having a configuration similar to the first current mirror, and a second control block having a configuration similar to the second current mirror, both of which are connected between the first current mirror and the second current mirror, with corresponding transistors connected in series. A stable output voltage can be obtained irrespective of variations in the potential of the voltage source for the reference voltage generation circuit.

5 Claims, 6 Drawing Sheets

REFERENCE VOLTAGE GENERATION CIRCUIT PROVIDING A STABLE OUTPUT VOLTAGE

BACKGROUND OF THE INVENTION (a) Field of the Invention

The present invention relates to a reference voltage generation circuit for use in a semiconductor device, and more particularly, to a reference voltage generation circuit for providing a stable output voltage therefrom over a wide voltage range of the power source for the reference voltage generation circuit.

(b) Description of the Related Art

A reference voltage generation circuit is used in various kinds of semiconductor devices in order to stabilize circuit operation and semiconductor characteristics. For example, because of need for a voltage higher than a source voltage or need for a negative voltage, a nonvolatile memory device includes a booster circuit having a voltage regulating circuit so as to output a constant voltage. The reference voltage generation circuit is used in the voltage regulating circuit as a reference voltage source.

In the nonvolatile memory device, if an output voltage from the reference voltage generation circuit varies, the variation is amplified in the voltage regulating circuit, resulting in significant variation in an output voltage from the voltage regulating circuit. Since the output voltage of the voltage regulating circuit determines, for example, the amount of electrons to be injected into the floating gate of a nonvolatile memory cell, a reduction in the output voltage causes a reduction in the amount of electrons injected, thereby affecting the data holding characteristic of the nonvolatile memory device. In other words, variation in the output voltage of the reference voltage generation circuit impairs the reliability of the nonvolatile memory device.

Further, the reference voltage generation circuit determines the amount of current flowing through the internal circuits of a semiconductor device. Thus, variation in the output voltage of the reference voltage generation circuit causes significant variation in the current dissipation of the entire semiconductor device. Since a semiconductor device having current dissipation which does not meet a product standard or specification is rejected in a test, variation in the output voltage of the reference voltage generation circuit may impair the yield of semiconductor devices.

FIG. 1 is a circuit diagram of a conventional reference voltage generation circuit using a bandgap voltage of diode. The reference voltage generation circuit includes the following elements: a first current mirror circuit CM1 which includes p-channel transistors P1, P2, and P3, among which the transistor P2 is disposed on the reference side; a second current mirror circuit CM4 which includes n-channel transistors N1 and N2 connected in series with the transistors P1 and P2, respectively, and in which the transistor N1 is disposed on the reference side; a diode D1 connected in series with the transistors P1 and N1; a resistor R1 and a diode D2 connected in series with the transistors P2 and N2; and a resistor R2 and a diode D3 connected in series with the transistor P3.

The transistors P1, P2, and P3 have the same design dimension, and the transistors N1 and N2 have the same design dimension. An output voltage Vout is determined from a current Io output from the transistor P3 and the resistor R2. The diodes D2 and D3 are each composed of a plurality of (N) diodes that have the same design dimension as the diode D1 and are connected in parallel with one another.

The respective source terminals of the transistors P1 and P2 are connected to a voltage source Vdd, and the respective gate terminals of the transistors P1 and P2 are connected together. Accordingly, the transistors P1 and P2 are identical in drain current and gate-to-source voltage. Since the respective gate terminals of the transistors N1 and N2 are connected together, the transistors N1 and N2 have the same gate voltage. Assuming that the transistors N1 and N2 have the same dimensions, the transistors N1 and N2 have the same threshold voltage, which provides the same source potential therebetween. The bandgap voltages of the diodes D1 and D2 provide following expression.

$$R1(I_0+(kT/q)\ln(I_0/I_{SD2})=(kT/q)\ln(I_0/I_{SD1})$$

where $I_0$ is a current flowing through the transistors P1, P2, and P3, $I_{SD1}$ and $I_{DS2}$ are the respective saturation currents of the diodes D1 and D2; T is an absolute temperature; k is a Boltzman constant; and q is the charge of an electron.

The above expression is arranged to the expression given in terms of Io as follows:

$$Io=(1/R1)\times(kT/q)\times\ln N \quad (1)$$

Wherein N is the number of diodes D1.

Thus, the output voltage Vout is expressed by $$Vout=\chi R1\times Io+(kT/q)\times\ln(I_0/N\cdot I_{SD1})$$

Wherein $\chi$=R2/R1.

By substitution of Expression (1) into the above expression, Vout is expressed by $$Vout=(kT/q)\times[(\chi-1)\ln N+\ln\{(kT/q)/R1\cdot I_{SD1})\}+\ln(\ln N)\}] \quad (2)$$

When the respective nodes connected to the drains of the transistors P1, P2, and P3 are represented by nodes A, B, and C, the potential at node A is the sum of threshold voltage Vtn of the transistor N1 and forward voltage drop VD1 of the diode D1; the potential at node B is equal to a value obtained through the subtraction of threshold voltage Vtp of the transistor P2 from the source voltage Vdd; and the potential at node C is Vout as represented by Expression (2).

Even when the source voltage Vdd for the reference voltage generation circuit varies, the source-to-drain voltage Vsd of the transistor N1 and that of the transistor P2 remain substantially unchanged; however, the respective source-to-drain voltages Vsd of the transistors P1, P3, and N2 vary in association with variation in the source voltage Vdd. That is, the current $I_0$ flowing through current paths of each of the current mirror circuits CM1 and CM4 and the output voltage Vout vary in association with variation in the source voltage Vdd. As mentioned previously, variation in the reference voltage causes various drawbacks in semiconductor devices. Thus, variation in the output of the reference voltage generation circuit should be suppressed to a small magnitude.

FIG. 2 is a graph showing a voltage-current characteristic of an ordinary transistor, measured in a sate in which the gate-to-source voltage Vgs is fixed to a certain level. In FIG. 2, the Y axis represents a drain current Id, and the X axis represents the source-to-drain voltage Vsd. In a transistor, as the source-to-drain voltage Vsd increases with the gate-to-source voltage Vgs fixed at a certain level, the drain current Id increases. As a channel length (a distance between the source and the drain) L of a MOS transistor decreases, the amount of an increase in the drain current Id increases. This is because, as the channel length L decreases, the influence of the expansion of a depletion layer increases significantly.

FIG. 3 is a graph showing variation in drain current accompanying variation in the source voltage Vdd for the reference voltage generation circuit. When an output current $I_2$ is determined by the transistors N1 and N2, the source-to-drain voltage Vsd of the transistor P2, which is connected to function as a diode, is determined. The gate voltage of the transistor P3 is also determined. When the source voltage Vdd varies, the source-to-drain voltage Vsd of the transistor P3 increases. In this case, if the channel length L is relatively short, the output current varies significantly from $I_2$ to $I_3$.

In the reference voltage generation circuit, variation in output current due to variation in source voltage can be suppressed to a small magnitude by increasing the channel length L, as shown in FIG. 2. However, when the channel length L is increased, a channel width W must be increased accordingly in order to maintain the transconductance of the transistor unchanged, causing a problem in that the surface area of a chip increases.

SUMMARY OF THE INVENTION

In view of the foregoing, an object of the present invention is to provide a reference voltage generation circuit that generates an output voltage to a high degree of accuracy over a wide range of source voltage for the reference voltage generation circuit without involving an increase in the surface area of a chip.

The present invention provides a reference voltage generation circuit comprising: a first current mirror including first through third transistors of a first conductivity type, the first through third transistors having sources connected together and implementing a first output side, a reference side and a second output side, respectively, of the first current source; a second current mirror including fourth and fifth transistors of a second conductivity type opposite to the first conductivity type, the fourth and fifth transistors implementing a reference side and an output side, respectively, of the second current mirror, the fourth and fifth transistors being connected in series with the first and second transistors, respectively; first and second current sources (R1, R2) connected in series with the second and fifth transistors and with the third transistor, respectively, for defining current flowing therethrough; and a voltage control block for controlling a source-to-drain voltage of the first and third transistors within a specified range.

In accordance with the present inventions the voltage control block controls the output voltage of the reference voltage generation circuit irrespective of variation in the source voltage for the voltage generation circuit by controlling the source-to-drain voltage of the first and third transistors within the specified range.

The above and other objects, features and advantages of the present invention will be more apparent from the following description, referring to the accompanying drawings.

DESCRIPTION OF THE PREFERRED EMBODIMENTS

Figure 1:
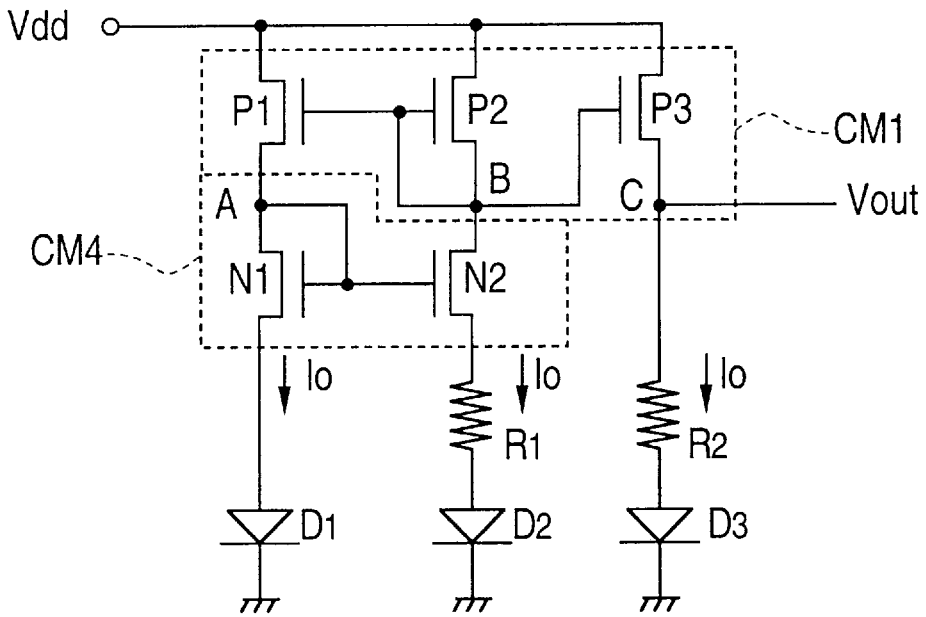
FIG. 1 (PRIOR ART)
FIG. 1 is a circuit diagram of a conventional reference voltage generation circuit.
Figure 2:
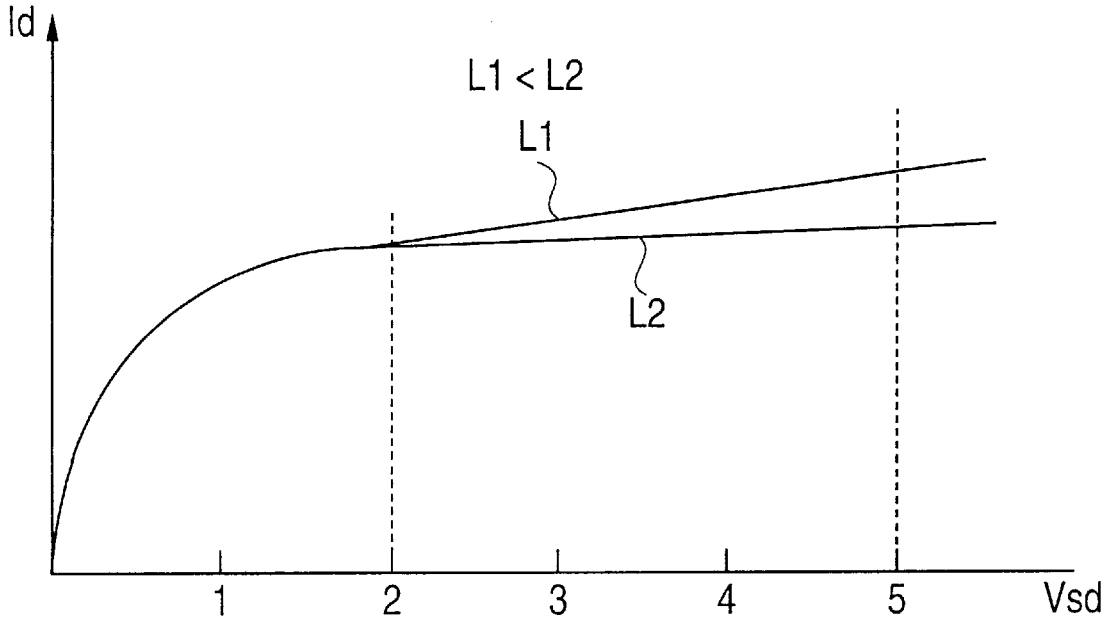
FIG. 2 (PRIOR ART)
FIG. 2 is a graph illustrating the effect of channel length L on drain current Id vs source-to-drain voltage Vsd.

Embodiments of the present invention will now be described in detail with reference to the drawings, wherein similar constituent elements are designated by similar reference numerals throughout the drawings.

Figure 4:
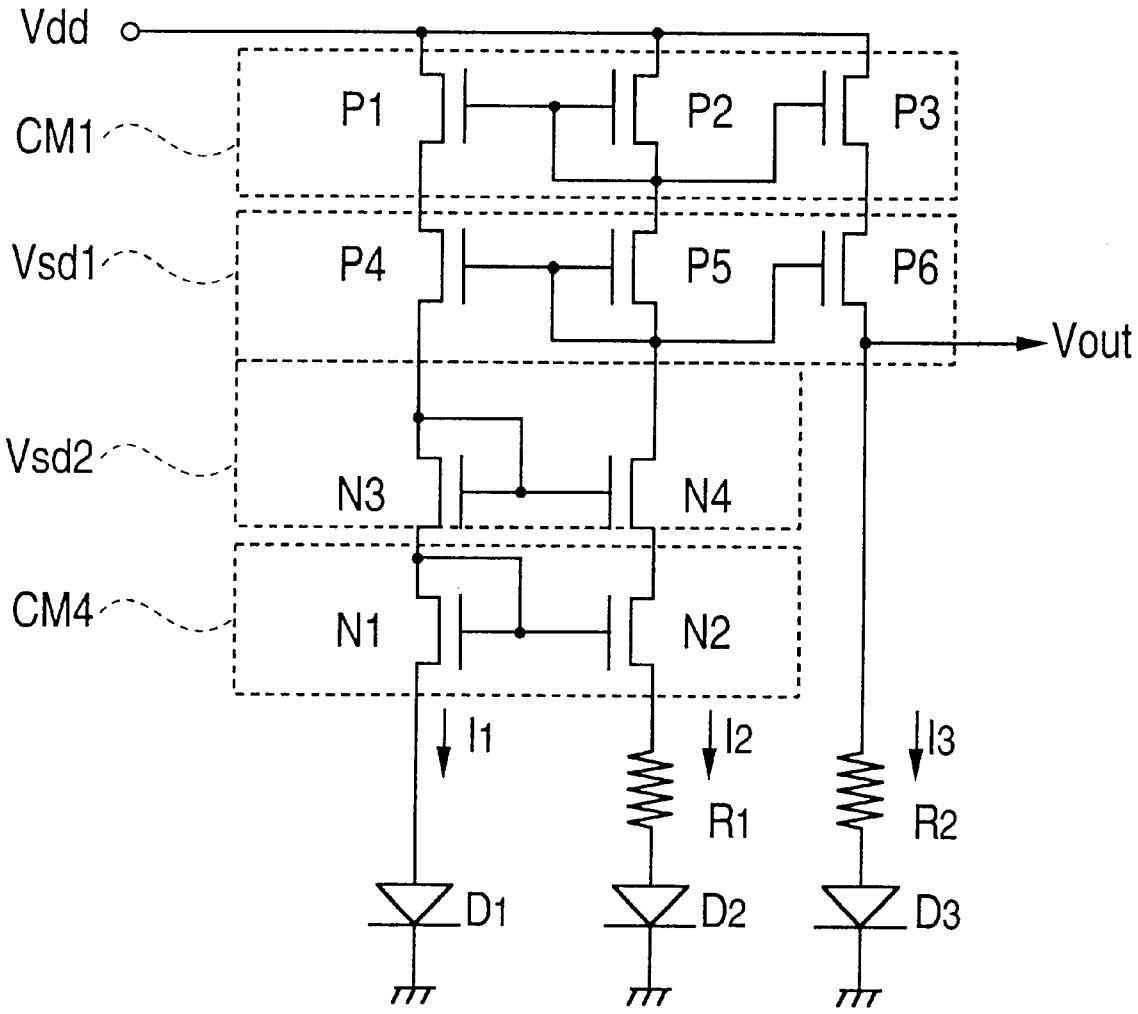
FIG. 4 is a circuit diagram of a reference voltage generation circuit according to a first embodiment of the present invention.

Referring to FIG. 4, a reference voltage generation circuit according to a first embodiment of the present invention includes a first current mirror circuit CM1, a first source-to-drain voltage control circuit Vsd1, a second source-to-drain voltage control circuit Vsd2, and a second current mirror circuit CM4. The first current mirror circuit CM1 includes a p-channel transistor P2 disposed on the reference side and p-channel transistors P1 and P3 disposed on the output side. The first source-to-drain voltage control circuit Vsd1 is composed of p-channel transistors P4 to P6 such that the gate terminals of the transistors P4 to P6 are connected together and such that the drain and gate terminals of the transistor P5 are connected together. The second source-to-drain voltage control circuit Vsd2 is composed of n-channel transistors N3 and N4 such that the gate terminals of the transistors N3 and N4 are connected together and such that the drain and gate terminals of the transistor N3 are connected together. The second current mirror circuit CM4 includes an n-channel transistor N1 disposed on the reference side and an n-channel transistor N2 disposed on the output side.

The transistors P1, P4, N3, and N1 are connected in this serial order as viewed from a voltage source Vdd, thereby forming a first current path. The transistors P2, P5, N4, and N2 are connected in this serial order as viewed from the voltage source Vdd, thereby forming a second current path. The transistors P3 and P6 are connected in this serial order as viewed from the voltage source Vdd, thereby forming a third current path.

The reference voltage generation circuit further includes a diode D1 connected between the ground and the source terminal of the transistor N1 in the first current path; a resistor R1 and a diode D2 connected in series between the ground and the source terminal of the transistor N2 in the second current path; and a resistor R2 and a diode D3 connected in series between the ground and the drain terminal of the transistor P6 in the third current path. The drain of the transistor P6 forms an output node Vout. The diodes D2 and D3 are each composed of a plurality of (N) diodes that have the same design dimensions as the diode D1 and are connected in parallel with one another.

Figure 5:
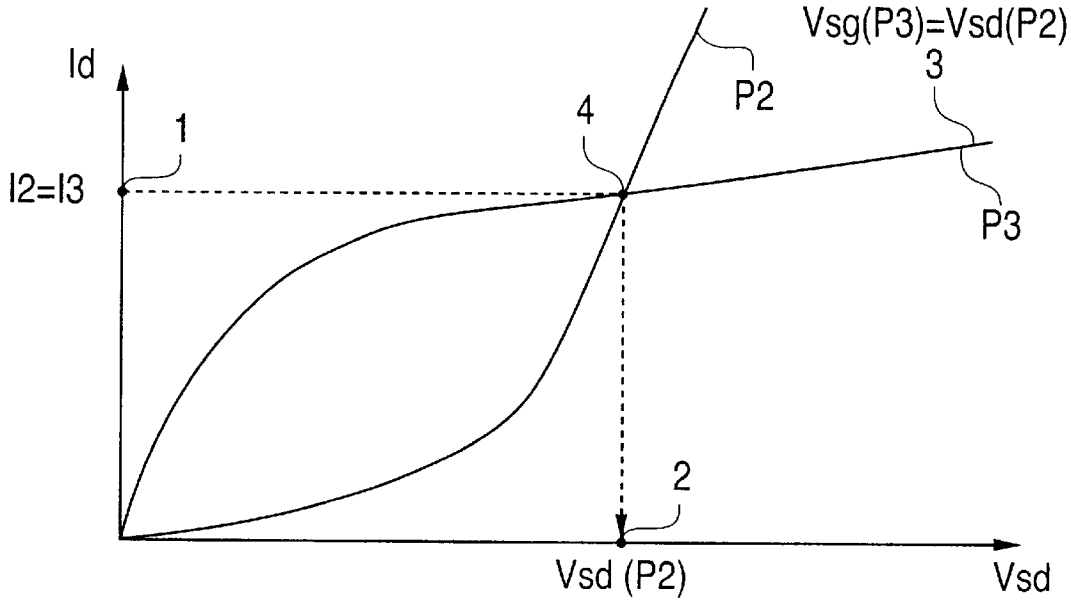
FIG. 5 is a graph showing the voltage-current characteristics of p-channel transistors P2 and P3 of a current mirror circuit.
Figure 6:
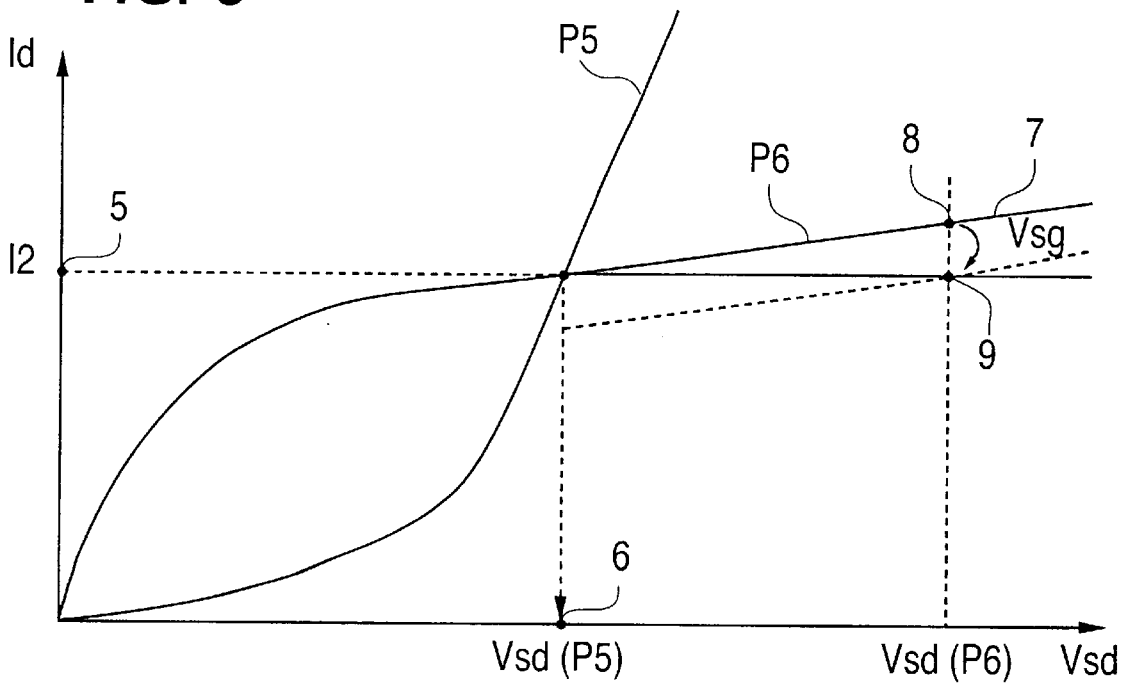
FIG. 6 is a graph showing the voltage-current characteristics of transistors P5 and P6 of a source-to-drain voltage control circuit.

The operation of the reference voltage generation circuit according to the present embodiment will next be described with reference to the graphs of FIGS. 5 and 6. FIGS. 5 and 6 show the voltage-current characteristics of the p-channel transistors disposed on the reference and output sides. Numerals (1) to (9) appearing in FIGS. 5 and 6 denote the sequence of operation and correspond to items of description below.

First, the operation of the transistors P2 and P3 will be described.

(1) By virtue of the resistor R1 acting as a current source and the diodes D1 and D2 providing a bandgap voltage, the current $I_2$ assumes a predetermined value as described previously in the section of the prior art.

(2) Since the gate and drain terminals of the transistor P2 are connected together, the relationship between the drain current Id and the source-to-drain voltage Vsd of the transistor P2 exhibits a diode characteristic. Accordingly, the source-to-drain voltage Vsd of the transistor P2 is determined in correspondence to the current I2.

(3) The relationship between the drain current Id and the source-to-drain voltage Vsd of the transistor P3 substantially exhibits a constant-current characteristic so long as the gate-to-source voltage Vsg of the transistor P3 is constant.

(4) Since the respective gate terminals of the transistors P2 and P3 are connected together, the gate-to-source voltage Vgs of the transistor P3 is equal to the source-to-drain voltage Vsd of the transistor P2. That is, the transistors P2 and P3 operate at the intersection of two characteristic curves of FIG. 5, thus establishing $I_2=I_3$.

Next, the operation of the transistors P5 and P6 will be described. Since the gate and drain terminals of the transistor P5 are connected together, the drain voltage of the transistor P5 is equal to a value obtained through the subtraction of the sum of the threshold voltages of the transistors P2 and P5 from the source voltage Vdd. The source voltage of the transistor P6 is equal to a value obtained by subtracting the sum of the threshold voltages of the transistors P2 and P5 from the source voltage Vdd and adding to the resultant difference the threshold voltage of the transistor P6. The threshold voltage of the transistor P5 is equal to that of the transistor P6. Accordingly, the source voltage of the transistor P6 is equal to a value obtained through the subtraction of the threshold voltage of the transistor P2 from the source voltage Vdd, and the drain voltage of the transistor P2 becomes equal to that of the transistor P3. As described above in item (4), the drain current $I_3$ of the transistor P3 is equal to $I_2$.

(5) Since the transistor P5 is disposed in the second current path in which the transistor P2 is disposed, the current $I_2$ flows through the transistor P5.

(6) Since the gate and drain terminals of the transistor P5 are connected together, the relationship between the drain current Id and the source-to-drain voltage Vsd of the transistor P5 exhibits a diode characteristic. Accordingly, when the drain current $I_2$ is determined, the source-to-drain voltage Vsd (P5) corresponding to the drain current $I_2$ is determined.

(7) Assuming that the source terminal of the transistor P6 is connected to a constant-voltage source, the transistor P6 exhibits a constant-current characteristic as in the case of the transistor P3. Specifically, the gate-to-source voltage Vgs of the transistor P6 exhibits a characteristic curve equivalent to that of the source-to-drain voltage Vsd(P5) of the transistor P5. When the source-to-drain voltage Vsd of the transistor P6 is equal to the source-to-drain voltage Vsd(P5) of the transistor P5, the drain current $I_3$ of the transistor P6 becomes equal to the drain current I2.

(8) When the source voltage Vdd increases, the source-to-drain voltage Vsd of the transistor P6 disposed at the output side of the first source-to-drain voltage control circuit Vsd1 increases, because a voltage appearing across the resistor R2 is substantially constant. Accordingly, the drain current I3 of the transistor P6 shows a tendency to increase. However, as described above in item (4), the transistor P3 limits the current flowing therethrough, resulting in that the drain voltage of the transistor P3 is slightly decreased.

(9) As a result, the gate-to-source voltage Vsg of the transistor P6 decreases; thus, even when the source voltage Vdd increases, the drain current 13 of the transistor P6 settles to the current $I_2$ determined by the transistor P2.

In the above description, only the relationship between the operation of the transistors P2 and P3 as well as that of the transistors P5 and P6 is described. As will be readily understood, the same applies to the p-channel transistor P1 disposed at the output side of the current mirror circuit CM1 and the n-channel transistor N2 disposed at the output side of the current mirror circuit CM4.

According to the first embodiment, through employment of source-to-drain voltage control circuit for controlling the source-to-drain voltage of the transistor disposed at the output side of the current mirror circuits, variation in output current is suppressed. Specifically, through addition of the p-channel transistors P4 to P6 and the n-channel transistors N3 and N4 to a conventional reference voltage generation circuit using a band-gap voltage, the source-to-drain voltages Vsd of the transistors P1, P3, and N2 disposed at the output side of the current mirror circuits can be limited. As a result, variation in voltage occurring in the load resistors R1 and R2 can be suppressed, so that the reference voltage can be generated to a high degree of accuracy. Even when employed transistors have a relatively short channel length L, the output voltage is stabilized, thus, the stabilization of output voltage is compatible with a reduction in the chip surface area of a semiconductor device.

Figure 7:
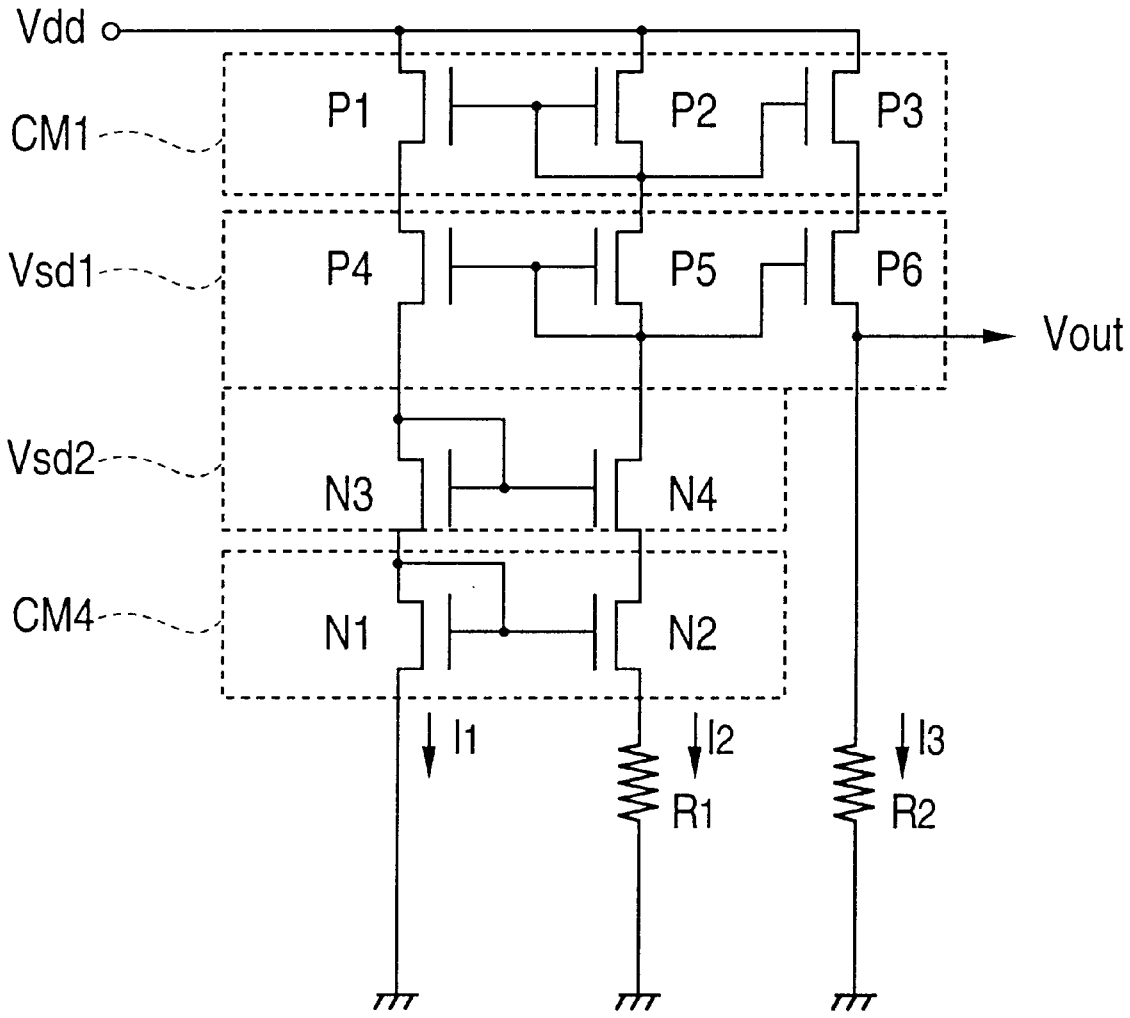
FIG. 7 is a circuit diagram of a reference voltage generation circuit according to a second embodiment of the present invention.

Referring to FIG. 7, a reference voltage generation circuit according to a second embodiment of the present invention is similar to the first embodiment except that the diodes D1 to D3 are omitted and that the dimension of the transistor N2 is a multiple (for example, 4 times) of that of the transistor N1. Assuming that the transistors N1 to N3 have a threshold voltage Vth, the transistors P1 to P6 have a threshold voltage Vtp, and currents $I_1$ to $I_3$ flow through the first to third current paths, respectively, the drain voltage of the transistor N3 becomes equal to 2Vtn; accordingly, the source voltage of the transistor N4 assumes Vtn. Even when the source voltage Vdd varies, the drain voltage of the transistor N2 assumes a constant value of Vtn. Accordingly, the source-to-drain voltage Vsd of the transistor N2 is constant; thus, even when the source voltage Vdd varies, the drain current $I_2$ of the transistor N2 is constant. The reference voltage generation circuit of the present embodiment, therefore, can suppress variation in reference current $I_2$ which would otherwise accompany variation in source voltage.

Similarly, in the case of the transistors P1 and P3 of the current mirror CM1 the source-to-drain voltage Vsd can be limited to the threshold voltage Vtp of a p-channel transistor. The drain voltage of the transistor P1 is equal to that of the transistor P3 and is equal to a value obtained through the subtraction of the threshold voltage Vtp of a p-channel transistor from the source voltage Vdd.

Accordingly, even when the source voltage Vdd varies, the source-to-drain voltage Vsd of each of the transistors P1 and P3 is substantially fixed at a constant level. That is, the output voltage Vout can be held constant.

Figure 8:
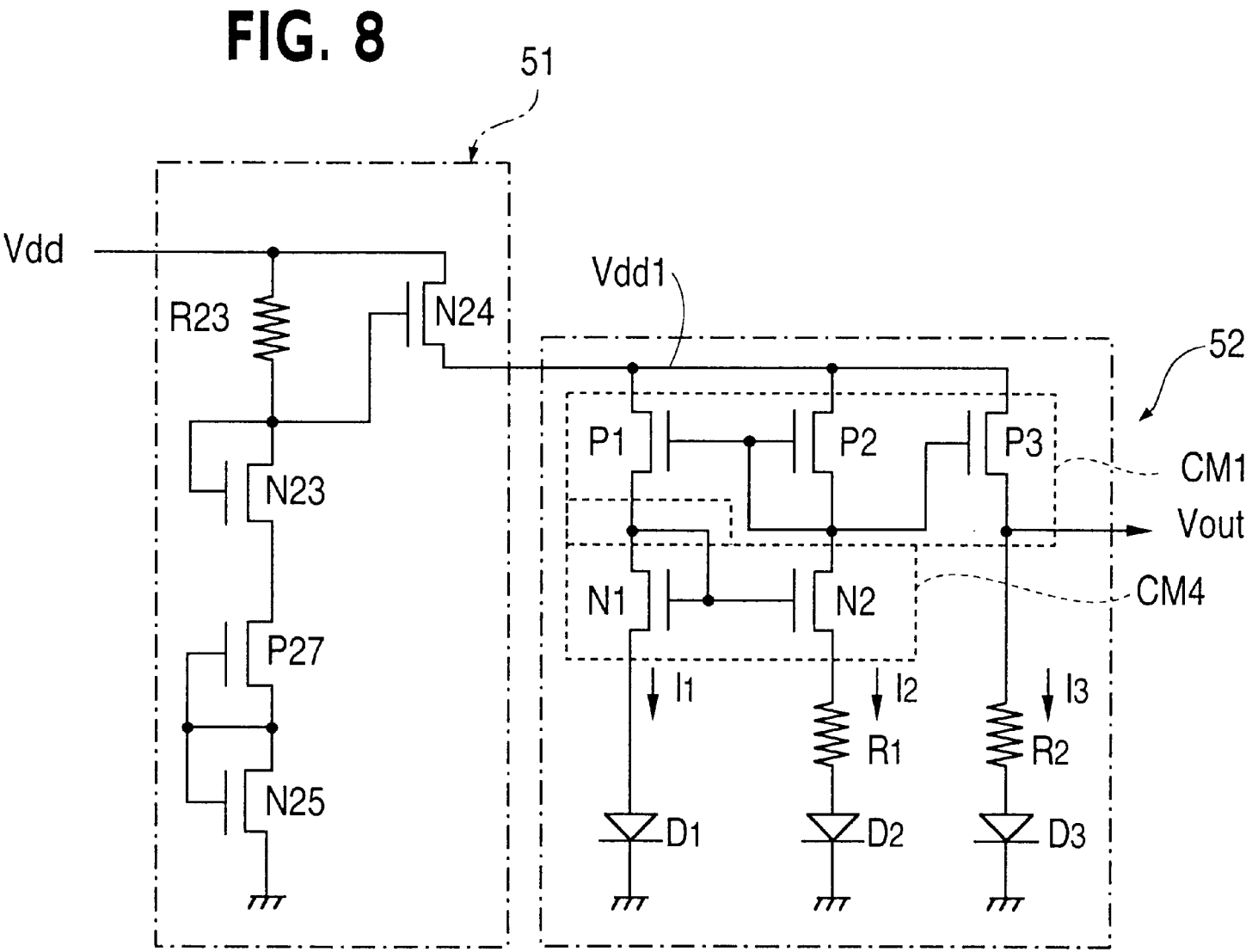
FIG. 8 is a circuit diagram of a reference voltage generation circuit according to a third embodiment of the present invention.

Referring to FIG. 8, a reference voltage generation circuit according to a third embodiment of the present invention includes a reference voltage generation section 52 configured in a manner similar to that of the conventional reference voltage generation circuit of FIG. 1 and a voltage limiter 51 provided on the source voltage side of the reference voltage generation section 52.

Figure 3:
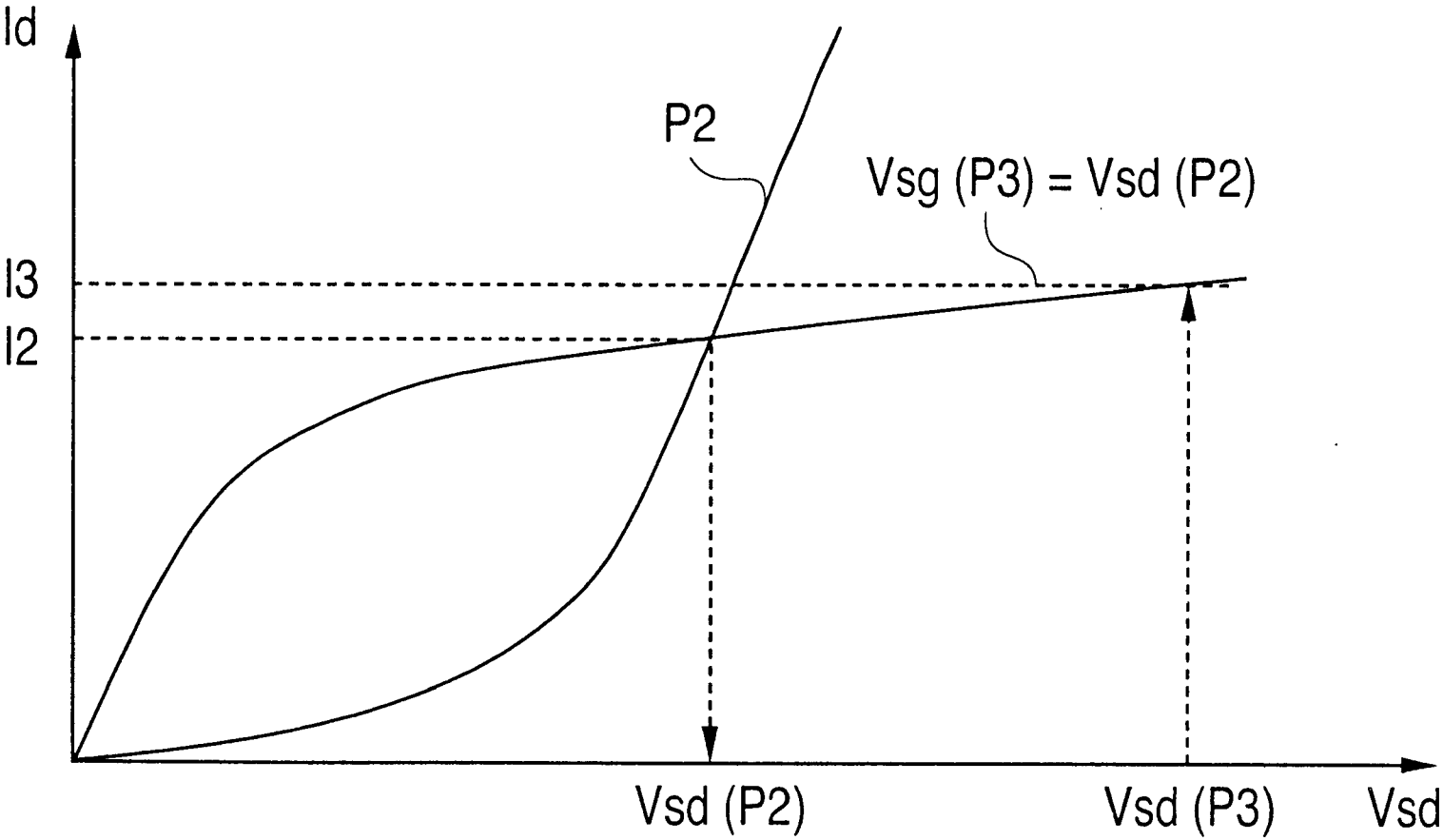
FIG. 3 (PRIOR ART)
FIG. 3 is a graph showing variation in drain current Id due to variation in source-to-drain voltage.

FIG. 3 shows variation in drain current accompanying variation in source voltage Vdd1 for the reference voltage generation section 51. When an output current $I_2$ is determined by the transistors N1 and N2, the source-to-drain voltage Vsd of the transistor P2, which is connected to function as a diode, is determined. The gate voltage of the transistor P3 is also determined. When the source voltage Vdd1 varies, the source-to-drain voltage Vsd of the transistor P3 increases. In this case, if the channel length L is relatively short, the output current varies significantly from $I_2$ to $I_3$.

The voltage limiter 51 includes a resistor R23, n-channel transistors N23, N24, and N25, and a p-channel transistor P27. The transistors N23, P27, and N25 are each connected to function as a diode. The resistor R23 and the transistors N23, P27, and N25 are connected in this serial order between the voltage source Vdd and the ground. The resistor R23 is adapted to make a predetermined current flow to the transistors N23, P27, and N25. Each of the transistors N23, P27, and N25 is connected such that the gate and drain terminals thereof are connected together. Since the threshold voltage Vtp plus a voltage equivalent to Vtn is built between the source and drain terminals of each of the transistors N23, P27, and N25, the drain voltage of the transistor N23 assumes (Vtp+2×Vtn). Thus the sum of the threshold voltages of a p-type transistor and two n-type transistors is provided to the gate of transistor N24. The transistor N24 implements a source follower circuit. The source voltage of the transistor N24 is equal to a value obtained through the subtraction of the threshold voltage Vtn from the gate voltage of the transistor N24. Accordingly, the source voltage of the transistor N24 assumes (Vtp+Vtn); for example, about 2 V. The drain terminal of the transistor N24 is connected to the source voltage line Vdd1 of the reference voltage generation section 52. The transistor N23 is adapted to compensate a voltage drop of the transistor N24. Alternatively, if a sufficiently large voltage is obtained only by use of the transistors P27 and N25 or when the employed transistor N24 has a relatively small threshold voltage, the transistor N23 may be omitted. Thus the gate of transistor N24 receives a voltage equal to the sum of the threshold voltages of a p-type transistor and an n-type transistor. The configuration of the voltage limiter 51 is not limited to that of the present embodiment, but may be modified so long as variation in source voltage can be suppressed to a small magnitude.

According to the present embodiment, the voltage limiter 51 is adapted to limit a source potential for the p-channel transistors P1 to P3 of the first current mirror circuit CM1 constituting the reference voltage generation section 52, thereby limiting the source-to-drain voltage Vsd of each of the transistors P1 to P3 to a predetermined range.

As described above, the source voltage input to the p-channel transistors P1 to P3 of the reference voltage generation section 52 is maintained at a constant level through voltage limit, thereby outputting a voltage to a high degree of accuracy over a wide range of the source voltage for the reference voltage generation circuit; for example, even when the source voltage Vdd ranges from 2.0 V to 5.0 V. An increase in the chip size of the reference voltage generation circuit is not involved.

The present embodiment requires an additional area in which the voltage limiter 51 is to be formed. However, since an area occupied by the MOSFET decreases in proportion to the square of the channel length L, an area occupied by the reference voltage generation circuit can be decreased through reduction in the channel length L even when the voltage limiter 51 is additionally formed. For example, by reducing the channel length L of a MOSFET from 100 $\mu$m to 20 $\mu$m, then area occupied by the MOSFET reduces by a factor of 25, thereby reducing an area occupied by the reference voltage generation circuit.

Since the above embodiments are described only for examples, the present invention is not limited to the above embodiments and various modifications or alterations can be easily made therefrom by those skilled in the art without departing from the scope of the present invention.

What is claimed is:

1. A reference voltage generation circuit comprising:

a first current mirror including first through third transistors of a first conductivity type, said first through third transistors having sources connected together and implementing a first output side, a reference side and a second output side, respectively, of said first current mirror;

a second current mirror including fourth and fifth transistor of a second conductivity type opposite to said first conductivity type, said fourth and fifth transistors implementing a reference side and an output side, respectively, of said second current mirror, said fourth and fifth transistors being connected in series with said first and second transistors, respectively;

first and second current sources connected in series with said second and fifth transistors and with said third transistor, respectively, for defining current flowing therethrough; and a voltage control block for controlling source-to-drain voltage of said first through third transistors within a specified range, the voltage control block comprising a sixth transistor of said second conductivity type having a source connected to a voltage source, a drain connected to the sources of said first through third transistors, and a gate fixed at a voltage corresponding to a sum of a threshold voltage of said first through third transistors and a threshold voltage of said fourth and fifth transistors.

2. The reference voltage generation circuit as defined in claim 1, wherein drains of said fourth, fifth and third transistors are connected to a voltage source through a first diode, a first resistor and a second diode connected in series, and a second resistor and a third diode connected in series, respectively, and said first and second resistors (R1, R2) implement said first and second current sources, respectively.

3. The reference voltage generation circuit as defined in claim 2, wherein each of said second and third diodes comprises a plurality of diodes connected in parallel and having a design size equal to a design size of said first diode.

4. A reference voltage generation circuit comprising:

a first current mirror including first through third transistors of a first conductivity type, said first through third transistors having sources connected together and implementing a first output side, a reference side and a second output side, respectively, of said first current mirror;

a second current mirror including fourth and fifth transistor of a second conductivity type opposite to said first conductivity type, said fourth and fifth transistors implementing a reference side and an output side, respectively, of said second current mirror, said fourth and fifth transistors being connected in series with said first and second transistors, respectively;

first and second current sources connected in series with said second and fifth transistors and with said third transistor, respectively, for defining current flowing therethrough; and a voltage control block for controlling source-to-drain voltage of said first through third transistors within a specified range, the voltage control block comprising a sixth transistor of said second conductivity type having a source connected to a voltage source, a drain connected to the sources of said first through third transistors, and a gate fixed at a voltage corresponding to a sum of double the threshold voltages of said first through third transistors and a threshold voltage of said fourth and fifth transistors.

5. A reference voltage generation circuit comprising:

a first current mirror including first through third transistors of a first conductivity type, said first through third transistors having sources connected together and implementing a first output side, a reference side and a second output side, respectively, of said first current mirror;

a second current mirror including fourth and fifth transistor of a second conductivity type opposite to said first conductivity type, said fourth and fifth transistors implementing a reference side and an output side, respectively, of said second current mirror, said fourth and fifth transistors being connected in series with said first and second transistors, respectively;

first and second current sources connected in series with said second and fifth transistors and with said third transistor, respectively, for defining current flowing therethrough; and a voltage control block for controlling source-to-drain voltage of said first through third transistors within a specified range, the voltage control block comprising:

a sixth transistor of said second conductivity type having a source connected to a voltage source and a drain connected to the sources of said first through third transistors, and in series between said voltage source and ground, a resistor, a seventh transistor of said first conductivity type, an eighth transistor of said second conductivity type, and a ninth transistor of said first conductivity type, gates of said seventh, eighth and ninth transistors being connected to respective drains thereof, and a gate of said sixth transistor receiving a voltage from a node joining said resistor and said seventh transistor.

* * * * *